US009668581B1

(12) United States Patent
Hill

(10) Patent No.: US 9,668,581 B1
(45) Date of Patent: Jun. 6, 2017

(54) KNOCKDOWN SOFA

(71) Applicant: Prominence Furniture & Finishing, Inc., Thomasville, NC (US)

(72) Inventor: Scotty W. Hill, Thomasville, NC (US)

(73) Assignee: Prominence Furniture & Finishing, Inc., Thomasville, NC (US)

( * ) Notice: Subject to any disclaimer, the term of this patent is extended or adjusted under 35 U.S.C. 154(b) by 15 days.

(21) Appl. No.: 14/514,598

(22) Filed: Oct. 15, 2014

(51) Int. Cl.
*A47C 17/04* (2006.01)
*A47C 4/02* (2006.01)

(52) U.S. Cl.
CPC ..... *A47C 4/02* (2013.01); *A47C 17/04* (2013.01)

(58) Field of Classification Search
CPC ..... A47C 17/04
USPC ..... 297/440.1, 440.15
See application file for complete search history.

(56) References Cited

U.S. PATENT DOCUMENTS 3,608,959 A * 9/1971 Sarvas ..... A47C 4/028 297/218.3
3,695,690 A * 10/1972 Carson ..... A47C 31/11 297/218.3
3,929,375 A * 12/1975 Gans ..... A47C 4/02 297/440.23
3,973,800 A * 8/1976 Kogan ..... A47C 13/005 297/135
4,204,287 A 5/1980 Lane et al. ..... 5/18
4,621,381 A * 11/1986 Schramek ..... A47C 4/028 297/440.13
4,919,485 A * 4/1990 Guichon ..... A47C 4/03 297/440.15
5,263,764 A 11/1993 Laughlin et al. ..... 297/440.23
5,338,095 A 8/1994 Laughlin et al. ..... 297/440.1
5,551,757 A 9/1996 Glover ..... 297/440.23
6,241,317 B1 * 6/2001 Wu ..... A47C 4/02 297/440.1
6,595,592 B1 * 7/2003 Wieland ..... A47C 4/024 297/440.15
6,692,079 B2 2/2004 Guillot ..... 297/452.18
6,702,389 B2 * 3/2004 Hall, Jr. ..... A47C 31/02 297/440.1
6,725,523 B2 * 4/2004 Chiang ..... A47C 3/00 29/453
7,140,690 B2 * 11/2006 White ..... A47C 4/02 297/440.14
7,744,162 B2 * 6/2010 Griggs, Jr. ..... A47C 4/02 297/440.14
8,806,672 B1 8/2014 Raymond et al. ..... 5/12.1
2003/0151293 A1 * 8/2003 McLarty ..... A47C 4/028 297/440.15
2004/0021359 A1 * 2/2004 Chang ..... A47C 13/005 297/440.23

(Continued)

*Primary Examiner* — Timothy J Brindley
(74) *Attorney, Agent, or Firm* — Tuggle Duggins P.A.; Blake Hurt

(57) ABSTRACT

A knockdown sofa that includes a pair of angled struts affixed at opposing sides to a wooden base and configured to engage different ones of a pair of angled slats, each of the slats attached to different ones of a pair of side arms. The base also defines a pair of apertures configured to receive different ones of a pair of downwardly depending lugs affixed to the bottom of a sofa back, such that the entire sofa can be assembled quickly and easily without the need of tools. An embodiment of the sofa includes hook and loop strips connecting both the side arms and the back to the base.

16 Claims, 3 Drawing Sheets

(56) References Cited

U.S. PATENT DOCUMENTS

| | | | | |
|---|---|---|---|---|
| 2005/0179303 | A1* | 8/2005 | Owens | A47C 4/02 297/440.1 |
| 2005/0225153 | A1* | 10/2005 | Ou | A47C 4/028 297/440.1 |
| 2010/0270844 | A1* | 10/2010 | Hood | A47C 31/11 297/440.15 |

* cited by examiner

KNOCKDOWN SOFA

FIELD OF THE INVENTION

The invention herein pertains to furniture and particularly pertains to easy assembly or disassembly of a sofa with knockdown functionality.

DESCRIPTION OF THE PRIOR ART AND OBJECTIONS OF THE INVENTION

As the population grows and the environmental impact of dwelling spaces increases, it has become increasingly necessary to maximize the use of available space in living quarters. Particularly in apartments, dorm rooms, hotel rooms, mobile homes, and the like, the value of an easily assembled piece of furniture that can be disassembled in a simple manner cannot be overstated. To this end, there exists a need for high quality furniture that can be assembled or disassembled quickly and efficiently without sacrificing style or structural stability. Knockdown furniture is generally known in the art (see for example, U.S. Pat. No. 4,204,287 to Lane) but it is typically unsteady, resulting in an uneasy sitting or reclining experience. One solution to this shortcoming is to utilize mechanical fasteners to secure the various furniture components prior to use (see for example U.S. Pat. No. 5,551,757 to Glover). While this may result in a more structural stable piece of furniture, these fasteners increase the complexity, weight, and overall cost of the resulting chair or sofa. This is particularly important when the logistics of transporting furniture are considered, particular in large volumes and over long distances.

Thus, in view of the problems and disadvantages associated with prior art devices, the present invention was conceived and one of its objectives is to provide a knockdown sofa that is efficient to manufacture and simple to assemble and disassemble.

It is another objective of the present invention to provide a lightweight sofa that provides structurally stable seating without the added complexity and cost of mechanical fasteners.

It is still another objective of the present invention to provide a sofa with a back section that vertically engages a base section.

It is yet another objective of the present invention to provide a sofa with an arm that includes a slat, and a base with a strut configured to frictionally engage the slat.

It is a further objective of the present invention to provide a sofa with a pair of arms that each include a slat with a biased face, and a base with a pair of opposing struts, each strut configured for complementary frictional engagement with each of said biased faces.

It is still a further objective of the present invention to provide a sofa with an angled strut affixed to the side.

It is yet a further objective of the present invention to provide a sofa with a pair of biased struts affixed to one side.

Various other objectives and advantages of the present invention will become apparent to those skilled in the art as a more detailed description is set forth below.

SUMMARY OF THE INVENTION

The aforesaid and other objectives are realized by providing a knockdown sofa comprising a back, a base, and a pair of opposing side arms. The base is formed from a front, a rear, and a pair of lateral sides that connect to form a generally rectangular shape. Longitudinally along each side, one or more angled struts are affixed to the base, generally defining an upwardly configured, triangular shape with a hypotenuse angle of approximately forty-five degrees (45°) protruding therefrom. Correspondingly, each side arm includes one or more longitudinally oriented, angled slats attached to the arm, generally defining a downwardly configured, triangular shape with a hypotenuse angle of approximately forty-five degrees (45°). The angled slats are attached such that there is a void defined closer to the centerline of the side arm than the slat, permitting the corresponding strut to slide behind the slat and frictionally engage the opposingly oriented angle, forming a flush engagement therebetween.

The back includes one or more lugs, either attached or integrally formed with the back, resulting in a downwardly projecting member that defines one, more horizontally angled (approximately one hundred and ten degrees)(110°) face and one, more vertically angled (approximately ninety degrees)(90°) face. The base includes one or more apertures defining a corresponding opening, such that when the back is lowered into position atop the base, the lug is inserted into the aperture, forming a tight frictional engagement with the base. In use, when the struts engage the slats and the lugs engage the base, the instant sofa is a structurally stable piece of furniture, without the use of costly and inefficient attachment hardware. Hook and loop engagement between the side arms and base, and the back and base are used to ensure that the furniture does not inadvertently disassemble, for example if moved or jostled.

DETAILED DESCRIPTION OF THE PREFERRED EMBODIMENT AND OPERATION OF THE INVENTION

For a better understanding of the invention and its operation, turning now to the drawings, FIGS. 1-3A display the preferred embodiment of knockdown sofa 10 including base 11, side arms 12, 12', and back 13. Although represented in the figures and referred to throughout as "sofa 10", it should be understood that sofa 10 should not be limited to the depicted configuration and may include alternate furniture configurations without limitation, such as chairs, love seats, sectionals, chaise lounges, sofas of various cushion number, and the like. Sofa 10 is shown herein without covering or fabric for clarity, but it would be understood by one of skill in the art that sofa 10 may be covered or upholstered with a variety of materials such as fabric, leather, microfiber or the like. The preferred material to construct the various components of sofa 10 is wood, although other suitable materials such as metal, polymeric materials, synthetic blends, and so on are within the scope of the instant invention.

Figure 1:
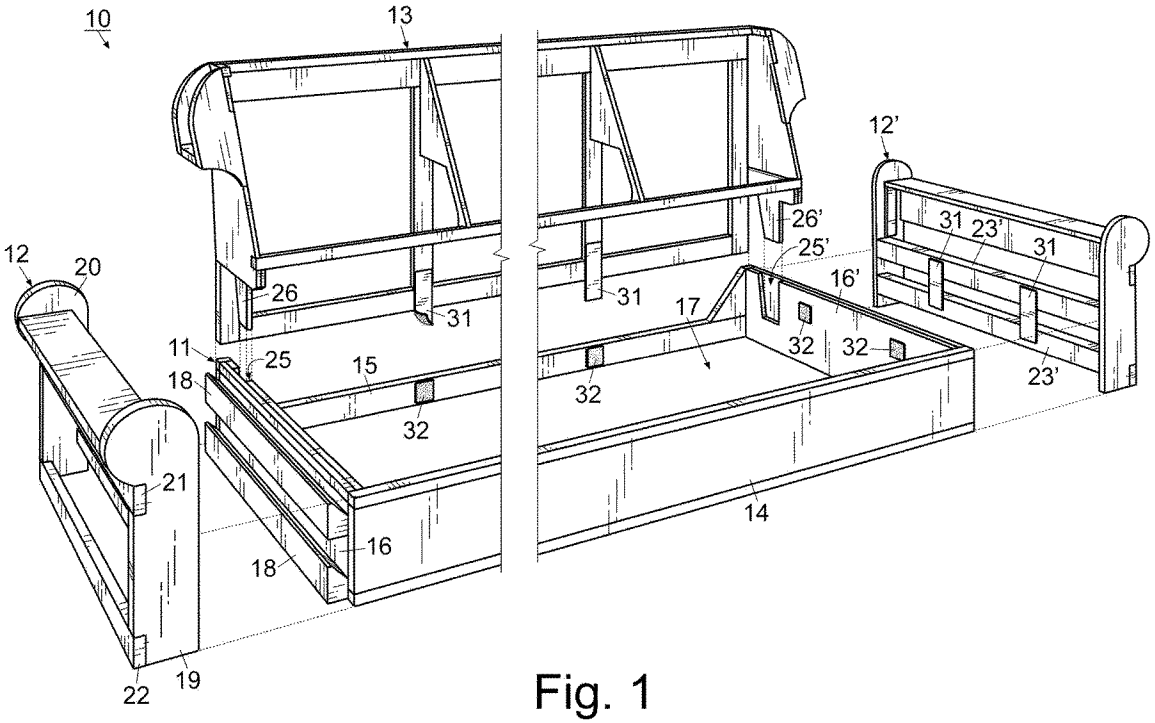
FIG. 1 shows a front, left side perspective view of a knockdown sofa of indeterminate length with the back and side arms exploded from the base.

FIG. 1 shows an exploded side perspective view of preferred knockdown sofa 10 with side arms 12, 12' and back 13 separated from base 11. Base 11 is formed from front planar member 14 and rear member 15, attached at opposing ends to planar side members 16, 16', for example by fasteners, adhesives, or other connecting means as known in the art (not shown). A triangular brace may be attached to rear member 15 and each of side members 16, 16' for added stability. Although preferred base 11 defines a rectangular shape for structural strength and stability, it is understood that base 11 may define any shape desired to form the base of a seating platform, such as a semi-circle, an L-shape or the like. As noted above, central space 17 defined by base 11 would be understood to contain structural elements such as fabric, springs, cushions and so on. In an embodiment of sofa 10 (not shown), central space 17 may contain a foldable mattress, for example the mattress disclosed in U.S. Pat. No. 8,806,672.

Base 11 preferably includes a plurality of polygonal struts 18 along substantially the entire length of base sides 16 and 16', respectively. While it is evident that one or more struts 18 may be attached at opposing sides of sofa 10, only one side of sofa 10 will be described for clarity and expediency and as understood applies equally to the opposing side. In the most preferred embodiment, base 11 includes a pair of struts 18 oriented longitudinally along the length of base side 16. Each strut 18 may define a height of three inches (3"), a width of one and a half inches (1.5"), a length matching substantially the width of sofa 10, such as thirty-six inches (36"), and is ideally formed out of a strong, stiff material such as wood. As shown clearly in FIGS. 1 and 2, struts 18 define a generally triangular cross-section with the two short sides of the "triangle" forming a ninety degree (90°) corner facing away from base 11 and the abbreviated hypotenuse side defining a face with a forty-five degree (45°) angle. While the angles and characteristics of strut 18 as described above are preferred, it should be understood that alternative embodiments of sofa 10 may have all, some, or a variation of these characteristics, and that the resulting sofa should still be considered within the scope of the instant invention.

Figure 2:
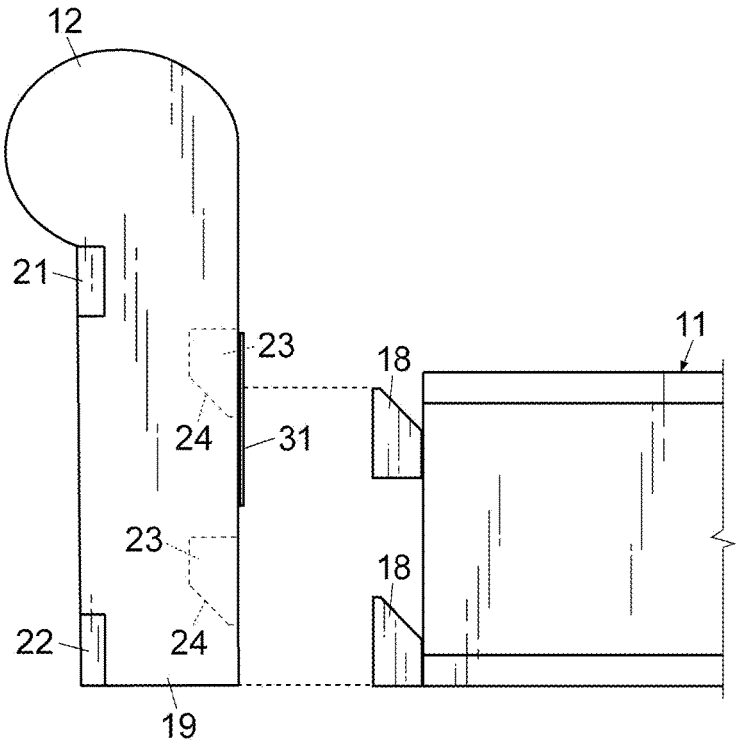
FIG. 2 pictures a front elevated partial view of one of the side arms prior to engagement with the base.
Figure 2A:
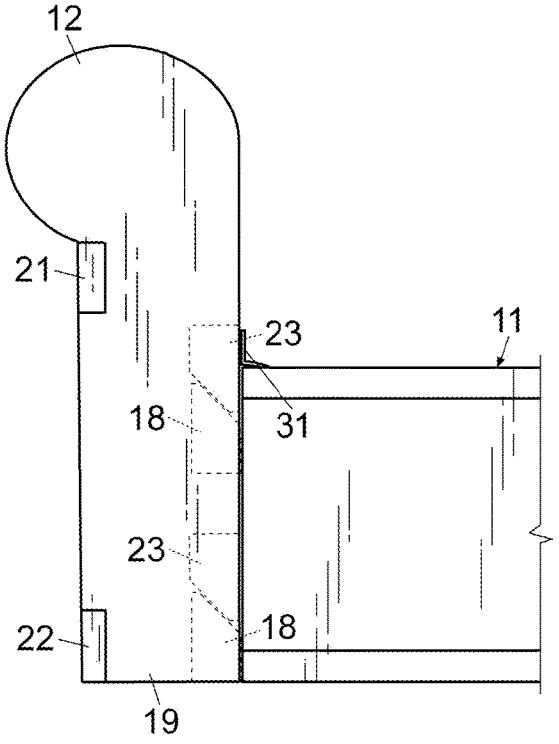
FIG. 2A depicts a front elevated view of the side arm of FIG. 2 engaged with the base.

FIGS. 2 and 2A represent elevated end views of struts 18 of base 11 disengaged from and engaged with side arm 12, respectively. Each of arms 12, 12' are formed from arm front 19 and arm rear 20, which preferably are vertically oriented, substantially planar members but in alternative embodiments may include aesthetically pleasing design features as is known in the art. Arms 12, 12' may also include one or more longitudinal supports such as supports 21 and 22 along the outer side. Supports 21 and 22 provide added structural stability to arms 12, 12', and add to the solid construction and "feel" of sofa 10. Arms 12, 12' also preferably include one or more slats 23, affixed longitudinally along the inner side of arms 12, 12' and opposingly attached to arm front 19 and arm rear 20. As best illustrated in FIGS. 2 and 2A, preferred slat 23 defines a downwardly oriented triangular shape with a biased face 24, presenting a horizontally flipped mirror image of strut 18. Likewise, slat 23 may define a ninety degree (90°) corner protruding away from base 11 and the abbreviated hypotenuse side defining a face with a forty-five degree) (45°) angle. As shown in FIG. 2A prior to engagement, arm 12 may be lifted above base 11, allowing slats 23 to go overtop struts 18 which pass within arm 12 whereby arm 12 is lowered to allow slats 23 to slideably, frictionally engage with struts 18. The cooperative bias defined by struts 18 and slats 23, respectively, resulting in a flush (i.e. non-overlapping) engagement between the two, requiring no additional hardware or fasteners to firmly attach arm 12 to base 11.

The orientation between struts 18 along base 11 and slats 23 along arms 12, 12' are not intended to be limiting, as variations in the shapes, sizes, angles, positioning and number thereof should be within the scope of the instant invention. Preferred struts 18 define a vertical gap of approximately four inches (4") between the tip of lower strut 18 and the bottom of upper strut 18, respectively. This gap allows sufficient space for the lowermost slat 23 of arm 12 to slide therebetween and slats 23 to settle atop struts 18, without requiring significant strength or angle rotation of arm 12 by a user to engage slats 23 with struts 18.

Figure 3A:
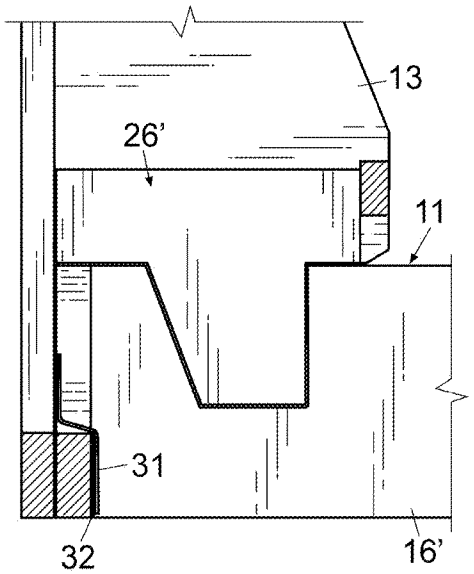
FIG. 3A illustrates an elevated side view of the back of FIG. 3 engaged with the base.
Figure 3:
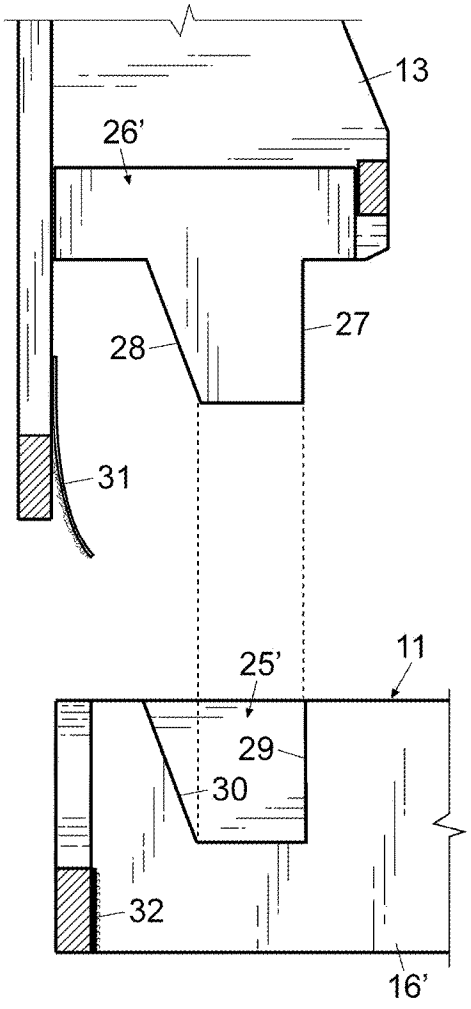
FIG. 3 demonstrates an elevated partial side view of the back prior to engagement with the base.

As further shown in FIGS. 1, 3, and 3A, base 11 may define respectively one or more apertures 25, 25' formed proximate the rear of sides 16, 16' configured to receive lugs 26, 26' attached to back 13 therein. As seen in FIG. 1, apertures 25, 25' are formed in only one side of each of sides 16, 16' which as shown herein each consist of two pieces rigidly joined together but as understood sides 16, 16' could be formed of one solid piece. As understood while only one side, aperture or lug may be described, such description equally applies to the opposing side, aperture or lug. Preferred lug 26 defines a T-shaped projection affixed to the bottom inside of a side member of back 13 and is positioned proximate the outer extremity of back 13, for example towards the peripheral edge thereof. Such placement of lug 26 allows the side member of back 13 to rest atop the outermost solid portion of base side member 16 as seen in FIG. 1 for added integrity and durability. The preferred embodiment of lug 26 defines a pair of biased faces, vertical face 27 and angled face 28 (see lug 26' in FIG. 3). Correspondingly, aperture 25 may be defined by a vertical wall 29 and an angled wall 30, creating a complementary aperture in side member 16 of base 11 to receive lug 26. As illustrated by only one side in FIGS. 3 and 3A, back 13 may be elevated over base 11, aligning lugs 26, 26' with apertures 25, 25' whereby the rear member of back 13 slides behind and abuts rear member 15 of base 11. Lugs 26, 26' may be inserted into apertures 25, 25' until firm, frictional engagement is achieved between vertical lug face 27 and vertical aperture wall 29 as well as between angled lug face 28 and angled aperture wall 30. As seen in FIG. 3A, the placement and positioning of back 13 having lug 26' within aperture 25' of base 11 prevents any unwanted longitudinal or lateral movement of back 13, particularly in the event negative, rearward pressure is applied. It should be understood that while the preferred lug and aperture configurations are described above, variations in the shapes, sizes, angles, and the like are within the scope of the instant invention. For example, while preferred lug angled face 28 defines an angle of one hundred and eight degrees (108°) and preferred lug vertical face 27 defines an angle of ninety degrees (90°), embodiments of lug 26 and corresponding aperture 25 may vary these values within the scope of the instant invention. In an alternate embodiment of sofa 10, lug 26 may include a strip of hook material configured to engage a corresponding strip of loop material positioned within aperture 25 for added stability.

As displayed in FIG. 1, preferred knockdown sofa 10 includes a plurality of hook strips 31 along back 13 and side arms 12, 12' and corresponding loop strips 32 along sides 16, 16' and rear member 15 of base 11. An embodiment of arm 12 may include a plurality of vertically oriented hook strips 31 attached to the sofa-facing face of uppermost slat 23, and base side 16 may carry corresponding loop strips 32 along the inside thereof. Similarly, an embodiment of back 13 may include a plurality of vertically oriented hook strips 31 positioned along the lowest segment of back 13 along the inner face thereof, and are configured to engage corresponding loop strips 32 positioned along the inside of base rear member 15. As seen in FIG. 1 hook strips 31 are longer than loop strips 32 to account for the overlapping of respective rear member 15 and sides 16, 16' during engagement and assembly to insure that hook strips 31 will fully engage loop strips 32 such as seen for example in FIG. 3A. While preferred hook strips 31 and loop strips 32 define a width of two inches (2"), it should be understood that strips of different sizes including length should be considered within the scope of the instant invention. Further, variables such as the number, positioning, orientation, and the like, of hook strips 31 and loop strips 32 should not be viewed as limiting factors of embodiments of sofa 10.

Back 13 is shown herein to define a generally triangular shape and include a plurality of vertical members spaced apart and affixed to horizontal members with a plurality of angled center members and opposing side members having an adjoining horizontal member positioned along the front thereof for added stability. Further the outer side members are shown with rounded shoulders affixed thereto proximate the top which in this embodiment matingly correspond with the rounded ends of side arms 12, 12' once assembled. As would be understood back 13 and side arms 12, 12' can be formed in a variety of configurations with regards to the shape, size, angles, and the like and the resulting sofas should still be considered within the scope of the instant invention.

A method of assembling knockdown sofa 10 includes the steps of providing base 11 having front member 14, rear member 15 having loop strips 32 and base sides 16, 16' each having loop strips 32 and a pair of opposing attached, angled struts 18 extending the longitudinal length thereof. Each of angled struts 18 includes a generally upwardly oriented triangular cross-section defining an angle of approximately forty-five degrees (45°). The method also includes providing a pair of side arms 12, 12' carrying hook strips 31, each arm 12, 12' including angled slats 23 that define a downwardly oriented triangular cross-section further defining an angle of approximately forty-five degrees (45°). Back 13 carrying hook strips 31 and defining a pair of downwardly projecting lugs 26, 26' in opposing relation configured for insertion into apertures 25, 25' defined in sides 16, 16' of base 11 are also provided. Side arms 12, 12' are each raised such that the points of angled struts 18 are below the bottom of slats 23, whereby side arms 12, 12' are each respectively moved forward and lowered thereon, until the corresponding angled faces of struts 18 and slats 23 are in frictional contact, forming a flush engagement as seen for example in FIG. 2A. During positioning and placement of arms 12, 12', hook strips 31 positioned on the uppermost slat 23 are laid overtop (FIG. 2A) respective side members 16, 16' of base 11 and engaged with loop strips 32 positioned on the inside of base 11. Back 13 is then lifted until lugs 26, 26' are positioned overtop apertures 25, 25' defined in base 11 as seen for example in FIG. 3 and lowered therein, forming a tight, frictional engagement between lugs 26, 26' and apertures 25, 25' respectively such as seen for example in FIG. 3A. Hook strips 31 positioned on back 13 are positioned overtop rear member 15 of base 11 and engaged with loop strips 32 positioned along the inside of base 11, forming a tight frictional engagement and forming a structurally sturdy sofa 10. Once sofa 10 is assembled, seating cushions, pillows or the like can be placed thereon as is conventional. Should sofa 10 need to be moved the cushions, etc. can be removed, the back hook strips 31 released from loop strips 32 and back 13 lifted to disengage lugs 26, 26' from apertures 25, 25'. Thereafter the side hook strips 31 released from loop strips 32 whereby arms 12, 12' can each be lifted and disengaged from their respective sides 16, 16' of base 11. Once disassembled the respective pieces of sofa 10 can be easily moved to a new location and thereafter assembled as previously described. The construction of sofa 10 makes it much easier and lighter to move when separated rather than moving a bulky, heavy one piece sofa and further no tools or fasteners are required for assembly or disassembly.

The illustrations and examples provided herein are for explanatory purposes and are not intended to limit the scope of the appended claims.

I claim:

1. A sofa comprising, an angled strut defining a polygonal shape and affixed to a base formed from a front member, a back member, and at least one side member, the base defining an aperture and a base width defined by a longitudinal length of the at least one side member, the angled strut extending substantially the base width and comprising a laterally extending portion, a vertically extending portion, and an angularly extending portion, the vertically extending portion joined to the laterally extending portion and the angularly extending portion at opposing ends thereof, the angularly extending portion defining a first engagement surface extending substantially the base width, an angled slat defining a polygonal shape and affixed to a side arm defining a longitudinal length, the angled slat extending substantially the side arm longitudinal length, the angled slat comprising a laterally extending portion, a vertically extending portion, and an angularly extending portion, the vertically extending portion joined to the laterally extending portion and the angularly extending portion at opposing ends thereof, the angularly extending portion defining a second engagement surface extending substantially the side arm longitudinal length, and a lug attached to a sofa back and configured for insertion with the aperture, whereby the side arm is affixed to the base via the first engagement surface cooperatively engaging the second engagement surface along substantially the base width.

2. The sofa of claim 1 whereby the angled strut defines a triangular-like shape.

3. The sofa of claim 2 whereby the angularly extending portion of the angled strut defines a forty-five degree (45°) face along a longitudinal length thereof.

4. The sofa of claim 1 whereby the angled slat defines a triangular-like shape.

5. The sofa of claim 4 whereby the angularly extending portion of the angled slat defines a forty-five degree (45°) face along a longitudinal length thereof.

6. The sofa of claim 1 further comprising a hook strip affixed to the side arm and a loop strip attached to the base.

7. The sofa of claim 1 further comprising a hook strip affixed to the sofa back and a loop strip connected to the base.

8. The sofa of claim 1 whereby the first engagement surface is in parallel orientation with respect to the second engagement surface, and whereby the first engagement surface and the second engagement surface define the same length.

9. A knockdown sofa comprising, a pair of angled struts affixed to an exterior surface and at opposing sides of a rectangular base formed from a front member, a back member, and a pair of opposingly oriented side members, the base defining a pair of apertures and a base width defined by a longitudinal length of at least one side member, the angled struts each extending substantially the base width and each angled strut comprising a laterally extending portion, a vertically extending portion, and an angularly extending portion, the vertically extending portion joined to the laterally extending portion and the angularly extending portion at opposing ends thereof, the angularly extending portion defining a first engagement surface extending substantially the base width, each of the angled struts defining a triangular-like shape, an angled slat attached to each of a pair of side arms, each side arm defining a longitudinal length, the respective angled slat extending substantially the side arm longitudinal length and comprising a laterally extending portion, a vertically extending portion, and an angularly extending portion, the vertically extending portion joined to the laterally extending portion and the angularly extending portion at opposing ends thereof, the angularly extending portion defining a second engagement surface extending substantially the side arm longitudinal length, each of the angled slats defining a triangular-like shape, and a pair of downwardly depending lugs attached to a sofa back and configured for insertion into each of the apertures, whereby the side arms attach to the base via each slat second engagement surface cooperatively and flushly engaging different ones of the strut first engagement surfaces along substantially the base width.

10. The sofa of claim 9 whereby each of the angled struts defines a forty-five degree (45°) face.

11. The sofa of claim 9 whereby each of the angled slats defines a forty-five degree (45°) face.

12. The sofa of claim 9 whereby each of the lugs defines a T-shape.

13. The sofa of claim 12 whereby each of the lugs defines a first face and a second face.

14. The sofa of claim 13 whereby the angle of the first face is different from the angle of the second face.

15. The sofa of claim 14 whereby the angle defined by the first face is ninety degrees (90°) and the angle defined by the second face is one hundred and eight degrees (108°).

16. The sofa of claim 9 whereby the first engagement surface is in parallel orientation with respect to the second engagement surface, and whereby the first engagement surface and the second engagement surface define the same length.

* * * * *